United States Patent [19]

Mercer, Jr.

[11] 3,938,492

[45] Feb. 17, 1976

[54] OVER THE WHEEL DRESSER

[75] Inventor: Norman Joseph Mercer, Jr., Hillsdale, Ill.

[73] Assignee: Boyar Schultz Corporation, Broadview, Ill.

[22] Filed: June 17, 1974

[21] Appl. No.: 479,603

Related U.S. Application Data

[62] Division of Ser. No. 394,506, Sept. 5, 1973.

[52] U.S. Cl. ..... 125/11 R; 51/165.87

[51] Int. Cl.[2] ..... B24B 53/04

[58] Field of Search ..... 51/165 R, 165.87, 165.88; 125/11 R

[56] References Cited

UNITED STATES PATENTS

| | | | |
|---|---|---|---|
| 2,813,378 | 11/1957 | Hill | 51/165.87 X |
| 2,931,145 | 4/1960 | Hill | 51/165.88 |
| 3,609,923 | 10/1971 | Hocking | 51/165.87 X |
| 3,798,845 | 3/1974 | Stevens | 51/165.87 |

FOREIGN PATENTS OR APPLICATIONS

| | | | |
|---|---|---|---|
| 1,351,778 | 3/1963 | France | 51/165.87 |

*Primary Examiner*—Harold D. Whitehead
*Attorney, Agent, or Firm*—Morris Spector

[57] ABSTRACT

A surface grinder having a grinding wheel mounted on a support and means for elevating the grinding wheel relative to a workpiece. A wheel dresser apparatus is mounted on the grinding wheel support. The wheel dresser apparatus includes a coarse adjustment means and a fine feed adjustment means for selecting the depth of dressing cut. Compensating means connects the fine feed adjustment means with grinding wheel support to move the grinding wheel towards the work the same amount as the depth of dressing cut.

3 Claims, 10 Drawing Figures

Fig. 1.
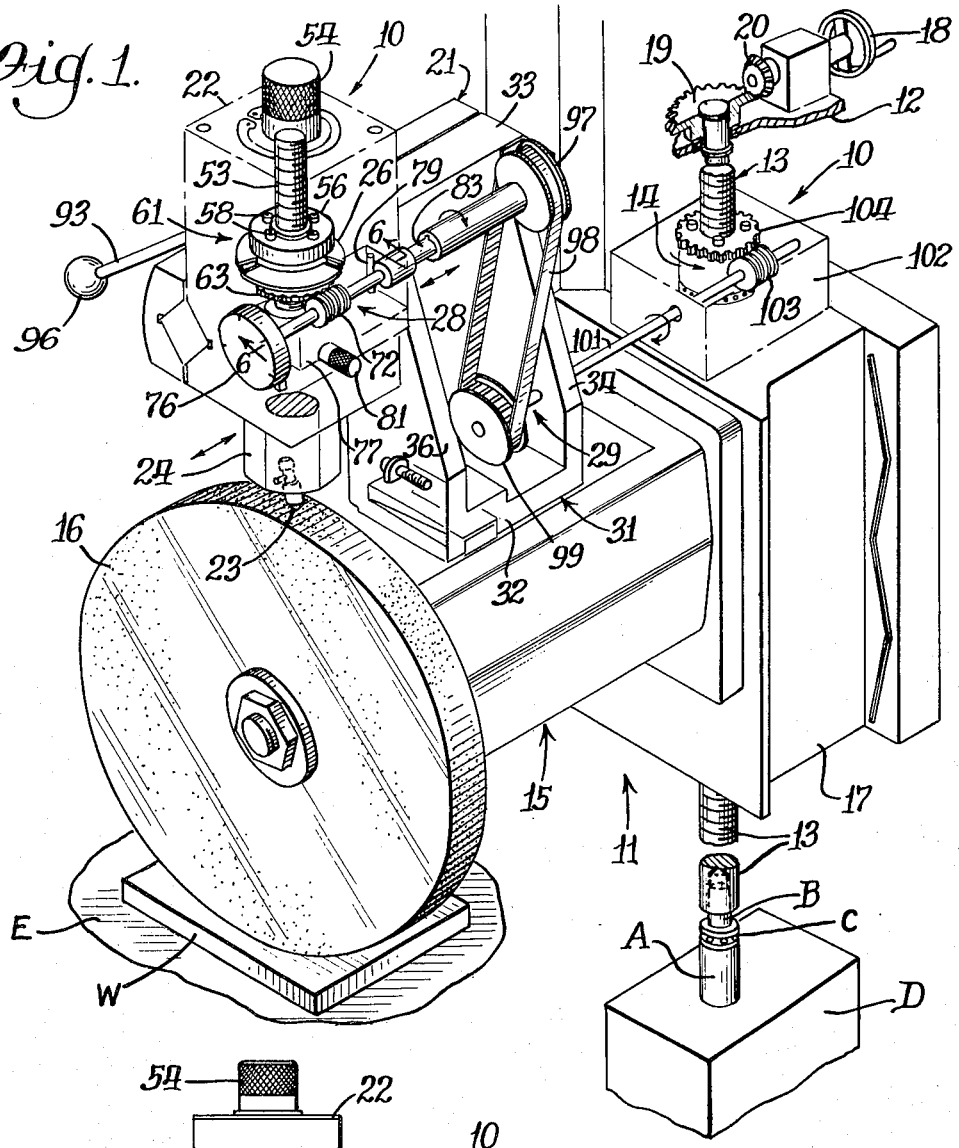
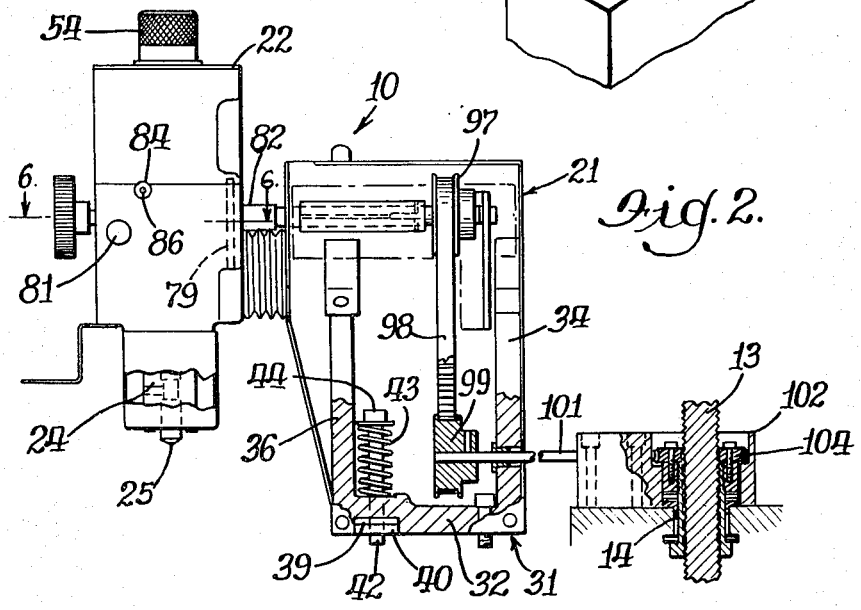
Fig. 2.

Fig. 3.
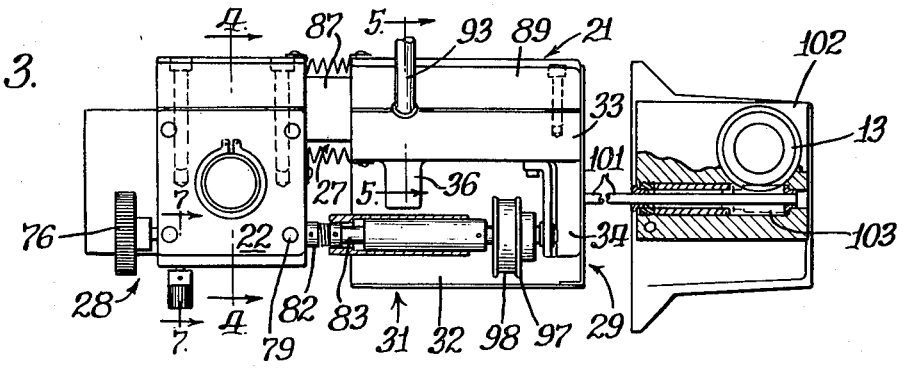
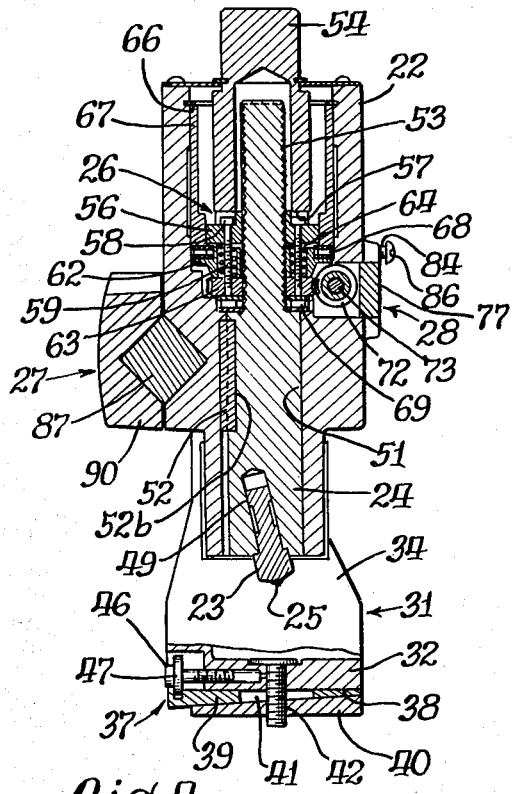
Fig. 4.
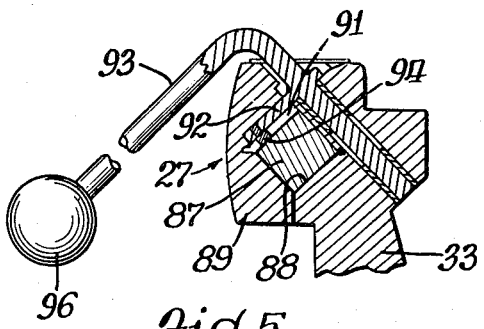
Fig. 5.
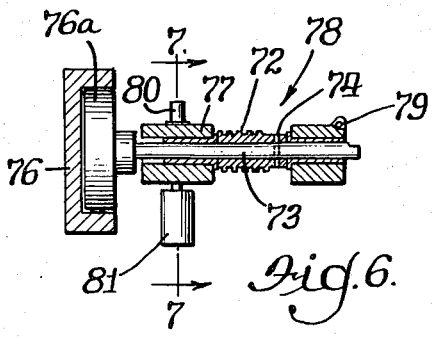
Fig. 6.
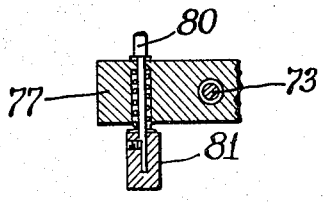
Fig. 7.

OVER THE WHEEL DRESSER

BACKGROUND AND SUMMARY OF THE INVENTION

This application is a division of my pending application Ser. No. 394,506, filed Sept. 5, 1973.

The present invention relates to a wheel dressing apparatus for surface grinders.

The present invention provides a wheel dressing assembly so associated with a surface grinder wheel head that the dressing tool of the wheel dressing assembly and the grinding wheel head are lowered in equal increments or amounts to maintain the accurate grinding wheel to workpiece relationship even though a wheel dressing operation may take place after the wheel head has been set. The necessity of resetting the wheel head after each wheel dressing is thereby eliminated. This is accomplished by a wheel dressing assembly mounted on the grinding wheel head and having a dressing diamond mount arranged for coarse adjusting movement to bring the dressing diamond head into engagement with the grinding surface of the grinding wheel and a fine adjusting movement to adjust the depth of dressing of the grinding wheel. A compensating means couples the fine feed dresser adjustment means with the mechanism that determines the depth of the total cut of the wheel to compensate for the depth of the dressing cut set by the fine feed adjustment means.

A feature of the invention is the provision of means for disengaging the compensating means from operative association with the wheel head so as to permit the diamond to be easily positioned on the peripheral surface of the grinding wheel without affecting the wheel head position.

A further feature of the invention is the provision of means for eliminating backlash in the positioning of the dressing diamond.

Further advantages and features of the invention will be apparent from a reading of the following specification and claims.

BRIEF DESCRIPTION OF THE DRAWINGS

FIG. 1 is a schematic perspective view of a surface grinder having a wheel dresser assembly incorporating the structure of the present invention.

FIG. 2 is a side elevational view of the dresser assembly partially in section to show underlying details and showing the sleeve nut housing attached to the wheel head housing.

FIG. 3 is a top plan view partially in section of the apparatus shown in FIG. 2.

FIG. 4 is a cross-sectional view taken generally along the lines 4—4 of FIG. 3 with parts of the slide head broken away to show underlying details of structure.

FIG. 5 is a cross-sectional view taken generally along the lines 5—5 of FIG. 3.

FIG. 6 is a cross-sectional view taken generally along the lines 6—6 of FIG. 2.

FIG. 7 is a cross-sectional view taken generally along the lines 7—7 of FIG. 6.

DESCRIPTION OF PREFERRED EMBODIMENT

Figure 8:
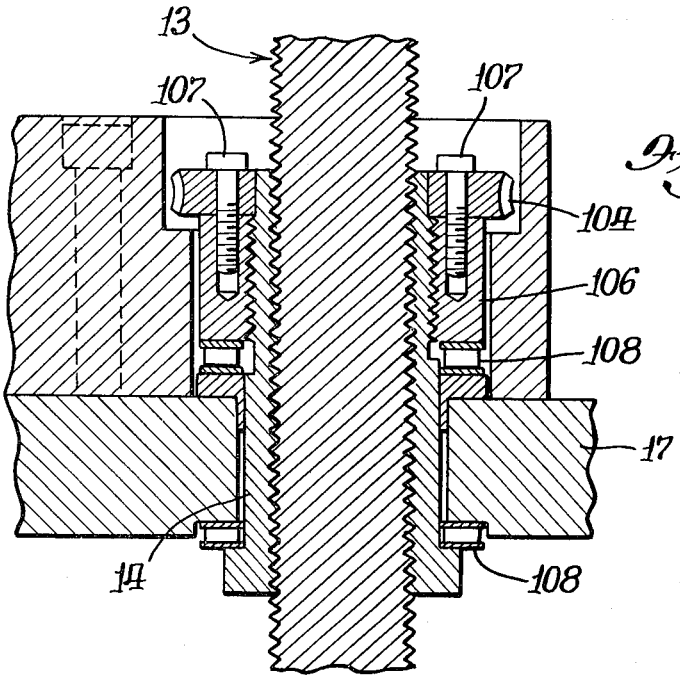
FIG. 8 is an enlargement of a portion of FIG. 2.

FIGS. 1 – 3 show a wheel dressing assembly 10 mounted on a surface grinder 11. The grinder 11 comprises generally a frame 12. A head elevator screw 13 is suspended from and rotated by a bevel gear 19 that is supported on the frame 12. The screw is splined to the gear by key 13*a* in keyway in the gear 19 and in the screw 13 to permit vertical raising movement of the screw to a limited degree. A nut 13*c* is threaded into the elevator screw 13. The head of the nut 13*c* is larger than the diameter of the elevating screw 13 and limits the downward movement of the elevator screw in the bevel gear 19 by coming to rest on the top face of the beveled gear 19. The gear 19 is rotated by a bevel gear 20 turned by a hand control 18, all mounted on the frame 12 as disclosed in my above application.

A spindle or wheelhead housing 17 is supported from the screw 13 by a screw bushing 14 and guided or confined for vertical movement by the frame 12 in a conventional manner. The wheelhead housing 17 supports a spindle-wheelhead 15 that carries a spindle for a grinding wheel 16, and the driving motor (not shown) for rotating the spindle.

The surface grinder to which the present wheel dressing assembly is attached is essentially that shown in my co-pending application, Ser. No. 268,017, filed June 30, 1972, now U.S. Pat. No. 3,822,512 to which reference is made and which disclosure is incorporated herein by reference. It includes a vertically extending jackscrew rod A that has a vertical pintal B formed at the upper end thereof, which extends into a socket at the bottom of the head elevator screw 13, the base of the pintal B being surrounded by a thrust bearing C which provides freedom of relative rotation between the two end to end members at all times, the pintal and socket relationship between the jackscrew rod A and the head elevator screw 13 permits relative vertical separation of the two while the pintal remains in guiding relationship in the bore of socket at the bottom of the head elevator screw. A jackscrew rod A is operated by an incremental mechanism D, more fully described in my above identified application, to raise the elevator screw 13 a selected amount, which is the total amount of the desired grinding cut. Raising of the elevator screw raises the wheel head 15 together with its associated parts, including the dressing apparatus, that is mounted on the wheelhead. The incremental mechanism D operates to back the jackscrew rod away from the head elevator screw 13 in selected increments for each swipe of the grinding wheel across the work, thus permitting selected depths of cut for each swipe, until the elevator screw 13 has lowered by the full amount that it had been raised by the jackscrew. Therefore, further backing away of the jackscrew rod is of no significance. This changes the distance between the spindle and a work table E that is mounted on the frame 12 and carries the work W that is to be operated upon back and forth in a prescribed manner as is customary in grinding machines. Adjustment of the wheelhead housing 17 vertically on the screw 13 changes the spindle-to-work-table distance. All of this is described in my above application and incorporated herein by reference.

The illustrated grinding machine is essentially the same as known constructions for manual grinding having the traveling worktable controlled by limit switches and associated components for running the worktable through a complete cycle each time it is actuated. In manual operation, the hand wheel 18 is adjusted to bring the grinding wheel 16 into contact with the surface of the workpiece and then is advanced by the operator after each cycle of table operation until the desired depth is reached. In grinding operation in which the grinding wheel 16 is dressed between grinding cycles, the wheel dressing assembly 10 of the present invention is used.

The wheel dressing assembly 10 comprises generally a dressing head frame 21 mounted on the wheelhead 15, a diamond head 22, a diamond mounting means 23 on a diamond mounting positioning or elevating screw 24 for movement of the diamond mounting means toward the grinding wheel. The diamond mounting means carries a dressing diamond 25. The diamond mounting means is adjusted by a coarse adjusting means 26 for moving the diamond into engagement with the periphery of the grinding wheel. A diamond head mounting means 27 is provided for guiding the diamond horizontally across the periphery of the grinding wheel 16. A fine feed adjustment means 28 is incorporated for adjusting the depth of the act of dressing.

A compensating means 29 is selectively positionable into and out of association with the fine feed adjustment means 28 so as to operatively couple the fine feed adjustment means 28 with the elevator screw 13 of the surface grinder. The compensating means lowers the grinder wheel head 15 an amount corresponding to the depth of cut set by the fine adjustment means 28.

The dressing head frame includes a bracket or cross slide 31 having a base 32 from which there projects a side wall 33 and a rear wall 34. A vertical gusset 36 is located adjacent the front edge of base 32. The base 32 is mounted or fastened to the wheel head 15 by means of bolts.

As shown in particular in FIGS. 2 and 4, a truing means 37 for the dressing diamond is seated in a groove 38 formed on the underside of the base 32. The truing means 37 includes a first tapered adjusting plate or gib 39 and a complementary second tapered adjusting plate or gib 40 of which the tapered faces are in face-to-face sliding engagement. The first or upper gib 39 has an elongated slot 41 which accommodates the shank 42 of a bolt 43 that passes through a hole in 32 and a pilot hole in 40, and screws into a threaded hole in the wheel head 15. A compression spring 44 extending between the bolt head 44 and the base 32 yieldably holds the tapered face of the lower gib 40 in engagement with the upper gib 39. A gib screw 46 threaded in the base 32 and having a head 47 seated in a slot 47 in the upper gib 39 serves to selectively position the upper gib 39 relative to the lower gib 40. Adjustment of the upper gib 39 permits the sweep of the diamond 25 to be maintained in parallelism with the turning axis of the grinding wheel.

As shown in FIG. 4, the diamond mount 23 is located in an inclined counterbored hole 49 in the lower end of the diamond positioning or elevating screw 24 and is locked in its radially adjusted position by a set screw. The screw 24 is guided in a vertical bore 51 in the head or housing 22 and at its lower end is keyed against rotation in the bore 51 by a key 52 (on a flat **52*a* formed on the screw 24) sliding in a longitudinal keyway 52*b* in the bore of the head 22. The upper end 53 of the positioning screw 24 is threaded and receives the coarse adjusting means 26**.

Figure 9:
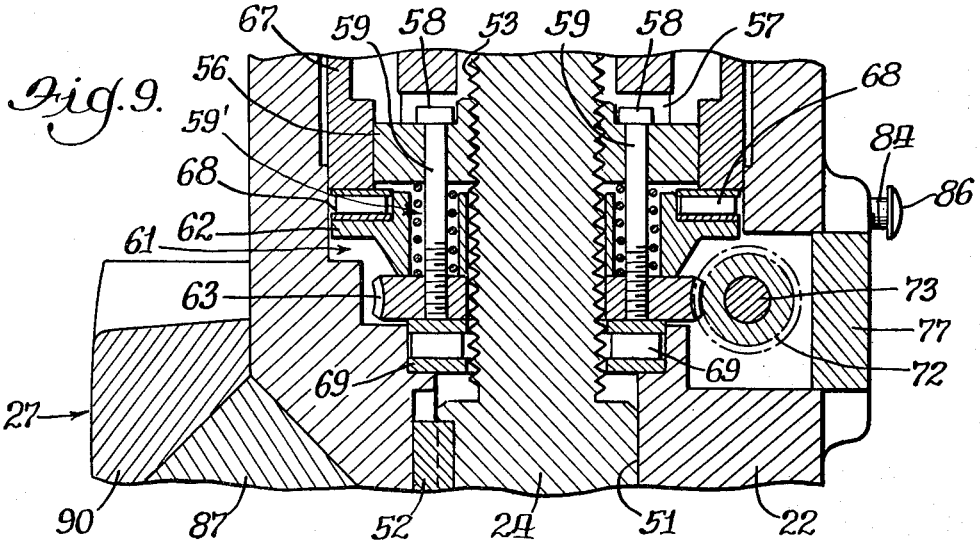
FIG. 9 is an enlargement of a portion of FIG. 4.
Figure 10:
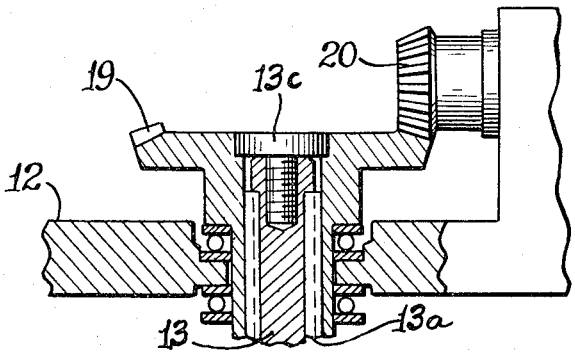
FIG. 10 is an enlargement of a portion of FIG. 1, showing a section through the top mounting of the grinding wheelhead elevator screw.

The coarse adjusting means 26 as shown in particular in FIGS. 1, 2 and 9 includes a positioning knob 54 which is captive against axial movement in the head 22 and actuates an adjusting nut 56 threaded on the positioning screw 24. The lower end of the knob 54 has slots 57 which accommodate the heads 58 of four, 90° spaced apart retaining screws 59 of a spring pre-load anti-backlash assembly 61 (FIG. 9). The assembly 61 includes the nut 56, an annular spacer 62 having bores accommodating the shanks of the screws 59, the lower ends of which are threaded into a fine feed worm gear 63. Springs 59 apply an upward biasing force against the nut 56 to prevent backlash. The adjusting nut 56, spring pre-load assembly 61 and the fine feed worm gear are held in axial position by means of a retaining ring 66 which retains a spacer sleeve 67 supported on a thrust bearing assembly 68 carried by the spacer 62. A second thrust bearing assembly 69 is seated on a co-shoulder 70 in the bore 51 of the head 22.

The adjusting nut 56 is free to rotate (when not restrained by the worm gear 63) while held captive against axial movement. The screw 24 is free to move axially while held against rotation by the key 52. The pre-load assembly 61 prevents back-lash of the screw 24. Turning the knob 54 clockwise, drives the screw 24 axially downward through the adjusting nut 56, to bring the dressing diamond into position for engagement with the periphery of the wheel 16.

The fine feed adjustment 28 comprises the worm gear 63 which is driven by a worm 72 fixed on a shaft 73. A knob 76 is coupled to one end of the shaft 73 by a unidirectional clutch **76*a* for rotating the shaft when the knob is turned in one direction. The clutch slips completely when the knob is turned in the opposite direction, so that the knob turns the worm gear 63** in only one direction.

The shaft 73 is mounted in a block or worm housing 77 having a recess 67 which accommodates the worm 72. The block is pivotally mounted on a diamond head 22 on a pivot pin 79 for pivoting in a horizontal plane to selectively engage or disengage the worm 72 from the worm gear 63. The housing is retained by a disengage knob 81 on a shank 80 which is captive on the housing 77 and spring biased and threaded into the diamond head 22. When the worm 72 engages the worm gear 63 it locks the worm gear from being turned by the nut 56 through the knob 54.

As shown in FIGS. 1 – 3, coupled to the fine adjustment shaft 73 of the fine feed adjustment means 28, by means of a spring type helical coupling 83, is one end of a splined coupling shaft 83 of the compensating means. The spring type coupling 82 is constructed in a well known manner to permit the block 77 carrying the worm 72 to be pivoted out of engagement with the worm gear 63. The diamond head is also permitted to be moved lengthwise relative to the fixed cross slide 31 by the splined connection 83. Limiting the pivotal movement of the block 77 is a stop screw 84 of which the head 86 is operative to engage the block 77 at the desired limit of disengagement of the worm 72 and worm gear 73.

The head 22, as shown in FIGS. 4 and 5, is fixedly attached to one end of a square bar 87 of the diamond head mounting means 27. One end of the bar is supported for sliding movement in a slideway 88 defined between side wall 33 and a plate 89. The diamond head 22 is tightly clamped against lengthwise sliding movement to the square bar by a clamping piece 90.

As shown in FIGS. 3 and 5 the square bar 87 is formed with a slot 91 which received a lug 92 diametrically extending from and fixed to an actuating rod 93. A pin 94 may be force fitted in the lug 92 to extend to the base of the slot 91. A handle knob 96 may be attached to the opposite end of the rod 93. The rod 93 is turnably journaled in the side wall 33 and the plate 89 so that upon rotation thereof, the square bar 87 is moved longitudinal thereby to move the head 22 and the diamond 23 fixed thereto across the periphery of the grinding wheel. Extensible bellows enclosing the bar 87 may be attached between the cross slide 31 and the head 22.

The compensating means 29 as shown in FIGS. 1 – 3 includes the coupling shaft 83 to one end of which there is suitably keyed a drive pulley 97. The drive pulley 97 drives by way of a belt 98 a driven pulley 99 which is fixed to a driven shaft 101. The driven shaft 101 is journaled at end end in the rear wall 34 and at the other end in a sleeve nut housing 102 fixedly mounted on the wheelhead housing 17.

A worm 103 is fixed for rotation with the driven shaft 101 and meshes with a worm wheel 104. The worm wheel 104 is secured by screws 107 to a spacer 106 which is threaded on the elevating screw bushing of sleeve nut 14. The sleeve nut 14 is retained against axial movement on the wheel head housing 17 between thrust bearing assemblies 108.

In operation, the worm wheel 104 and the sleeve nut 14 are free to rotate while held capitve against axial displacement relative to the wheel head housing 17. The elevator screw 13 is held captive against axial displacement in the assembly of the bevel gears 19 and 20 while resistance to rotation of the screw 13 is accomplished by the friction between the screw 13 and the elevating screw sleeve nut bushing 14.

Upon rotating the dressing knob 76 clockwise, the elevating screw motor bushing 14 will be rotated through the drive comprising the coupling shaft 83, pulley 97, belt 98, driven pulley 99, driven shaft 101, worm 103 and worm wheel 104. In view of the fact that the elevator screw 13 is not rotating, the rotating worm wheel 104 and bushing 14 cause the wheel head unit 15 and the dresser mounted thereon to drop under the force exerted by the weight of the wheel head 15.

The coarse adjustment means 26 may be operated only when the fine feed adjustment means 28 is disengaged. This is accomplished by unthreading the thumb screw 81 and rotating the block 77 about the pin 79 until the worm 72 is out of engagement with the worm wheel 63. Rotating the coarse adjustment knob 54 causes rotation of the axially fixed coarse adjustment nut 56. Rotation of the nut 56 clockwise causes the non-rotatable positioning screw or diamond mounting means 24 to be moved downwardly until the diamond engages the grinding surface of the grinding wheel. Caution must be exercised in positioning the diamond because this is a coarse adjustment.

The fine feed adjustment means 28 is turned about the pin 79 until the worm 72 again meshes with the worm wheel 63. The housing or block 77 is held in position by the thumb screw 81 which is threaded into the diamond head 22. The diamond dressing knob 76 is then rotated clockwise to one of the graduations on the knob to achieve the desired depth of dressing cut across the grinding wheel 16. Rotation of the knob 76 also rotates the worm 72 meshing with the worm wheel 63 held against axial movement in the diamond head.

The worm wheel 63 which threadably receives the positioning screw 24 moves the latter axially downward the desired amount.

Adjustment of the fine feed adjustment means 28 is transmitted to the compensating means 29 via the coupling shaft 83 to the sleeve nut 14 as previously explained above. The wheel head 15 and the diamond 23 are lowered in equal increments thereby retaining the same distance relationship between the cutting edge and the workpiece even after wheel dressing.

Thereafter, the handle 93 is pulled or pushed so that the square rod 87 carrying the diamond head 22 is moved in its guideway relative to the cross slide 31. The diamond 23 thus sweeps across the grinding surface of the wheel to make the desired dressing cut.

The next grinding cut may then be taken on the workpiece without making any manual adjustment of the wheel head 15 at the hand wheel 18 because of the adjustment made by the compensating means.

From the above description, it is apparent that the coarse adjusting means for adjusting the position of the diamond of the dressing tool establishes a zero or base position for the diamond from which the diamond is moved by the micro-adjusting means or fine adjusting means to determine the deviation in grinding wheel diameter due to the dressing action, the deviation from the base or zero position, which is the position in which the diamond has been placed by the coarse adjusting means.

An explanation will now be given of the operation of the machine above described.

OPERATION

1. Establish Diamond/Wheel Position
   - 1.1 Disengage Fine Feed.
     Rotate the Disengage Knob 81 (FIG. 6) counterclockwise until the fine adjusting Housing 77 swings to the stop position, bringing the worm 72 out of engagement with the worm gear 63.
   - 1.2 Position Diamond.
     Rotate the Diamond Positioning Knob 54 clockwise until the Diamond 23 contacts the Wheel. Exercise caution as this is a coarse adjustment.
   - 1.3 Rotate the Disengage Knob 81 (FIG. 6) clockwise to swing the Housing 77 clockwise about pivot 79 to engage the Worm 72 with the worm gear 63. Rotate the Diamond Dressing Knob 76 clockwise in 45° increments until the Worm Gear 73 and the Worm Wheel mesh.

1A. Principal of operation

- 1a.1 Worm Housing Disengagement.
  As the Disengage Knob 81 is rotated counterclockwise it threads itself from the Dresser Elevating Head 22 while the Worm Housing 77 pivots on pin 79 until it engages a stop. The Spring Type Helical Coupling 83 allows the pivoting to occur without a physical disengage. The Diamond may now be downfed independent of the Wheel Head.
- 1A.2 Coarse Feed Diamond Adjustment.
  The Diamond 23 (including its standard holder) is mounted in a counterbored hole in the Positioning Screw 24 to maintain centerline location and prevent axial deflection. The Positioning Screw 24 is guided vertically in the Dresser Head or Housing 22 and keyed against rotation. The Positioning Knob 54 drives the spring pre-loaded Adjusting Nut 56 (FIG. 9) through slots which engage the heads 58 of the Pre-load Assembly Retaining Screws 59 that extend through guide holes in the nut and at their lower ends carry the find feed worm gear 63. The adjusting Nut, Pre-load Assembly and Fine Feed Worm Gear 63 are held in axial position with the thrust washer 69 (FIG. 9) and Retaining Ring 67 (FIG. 4). The Adjusting Nut is free to rotate, while held captive axially, and the Positioning Screw is free to move axially while locked against rotation. Backlash is removed through the Pre-load Assembly. Rotating the Positioning Knob 54 clockwise drives the Positioning Screw 24 downward through the Adjusting Nut 56.

2. Dress the wheel 2.1 Traverse the Dressing Lever (item 58) to sweep the Diamond across the Wheel. The Dressing Knob 76 have five graduations; each equivalent to 0.0005 Diamond movement. Rotate the Dressing Knob clockwise the necessary amount to obtain the desired Diamond downfeed. Sweep the Diamond across the Wheel. Repeat as required to obtain desired dress. The rate of dressing sweep and Diamond downfeed increment is dependent upon user experience.

2A. Principals of operation 2A.1 The Diamond Head Traverse.

The Diamond Head (item 1) is rigidly mounted to the square bar 87 which traverses in a cross slideway 88. The Traverse Bar, square for maximum rigidity, is positioned by the Dressing Lever 93 through an integral link which engages a slot in the Traverse Bar. The dressing sweep is controlled by the confinement of the link in the slot. The cross slideway surfaces are scraped for squareness and the proper Traverse Bar fit.

2A.2 Fine Feed Diamond Adjustment.

The Worm Wheel 63 is free to rotate (by the worn 72), while held captive axially through thrust washers 68 and 69. The Positioning Screw 24 is free to move axially while locked against rotation. Rotating the Dressing Knob 76 clockwise drives the Positioning Screw downward through the threaded Worm Wheel. The Dressing Knob is connected through a Spline Coupling 83 (which permits movement of the diamond head across the wheel 16 by the handle 93) to the Belt Drive 98 to the worm shaft 101 that drives the Worm 103. The Worm 103 is pinned to the connecting shaft 101 and is in axial mesh with the Worm Wheel 104 through an Adjusting Lock Nut (item 24). Screws 107 secure the Worm Wheel to the Locknut 106 which retains the Elevating Screw Bushing in axial position with thrust washers. The Worm Wheel 104 is free to rotate while held captive axially. The Elevating Screw 13 is held captive axially while resistance to its rotation is accomplished through friction between the Elevating Screw and Elevating Screw Bushing. Rotating the Dressing Knob clockwise will rotate the Elevating Screw Bushing which coupled with a stationary Elevating Screw allows the Wheel Head to be lowered by its own weight such as in the principal of an escapement mechanism. The ratio between the Diamond Downfeed and Wheel Head Downfeed is 1:1.

3. Commence grinding 3.1 With the Elevating Handwheel, bring the Grinding Wheel to the top of the workpiece. Set the Elevating Slip Ring at zero. Determine amount of stock to be removed. Commence grinding.

4. Redress the wheel 4.1 Position the table so that the Grinding Wheel clears the workpiece. Repeat the dressing procedure outlined under paragraph 2. Commence grinding.

4A. Principals of operation 4A.1 Wheel to workpiece relationship maintained. The Diamond and Wheel Head are lowered in equal increments, as outlined under paragraph 2A.2, thereby maintaining the relationship between the wheel cutting edge and the top of the workpiece. This feature allows wheel dressing without changing the Wheel Head position with the Elevating Handwheel thereby maintinaing the original wheel to workpiece relationship and making it possible to remove a fixed amount of material without piece part inspection.

5. Diamond

The Diamond is mounted in the Positioning Screw (item 18) on the spindle centerline at an angle. As the Diamond point becomes dull, the Diamond is rotated within the Positioning Screw to generate a sharp diamond point for contact with the wheel.

6. Standard elevation positioning

As the Elevation Screw is rotated, the Worm Wheel (item 29) is locked against rotation by the Worm (103). The Elevating Screw is held captive axially by the Bevel Gear Assembly. Rotation of the Elevating Handwheel drives the Elevation Screw through Bevel Gears to raise or lower the Wheel Head 15.

I claim:

1. A wheel dresser assembly for a surface grinder, said assembly comprising a dresser elevation head, an elevating screw held in said head and having means for receiving and holding a dressing tool, means holding said screw in said head against rotation but permitting longitudinal dressing tool adjusting movement of the screw in said head, coarse adjusting means for moving the screw longitudinally to effect a first adjustment of the position of the tool, fine-feed adjusting means movable into and out of effective position for a fine longitudinal adjustment of the screw, and means included in the fine-feed adjusting means for disabling the coarse adjusting means when the fine-feed adjusting means is in its effective position, wherein the screw is held in said head by a nut through which the screw is threaded; a worm wheel secured to the nut, a gearing assembly included in the fine-feed adjusting means, said gearing assembly having a worm, and means mounting the assembly for movement to bring the worm into and out of engagement with the worm wheel.

2. The combination of claim 1 wherein there is provided a spring pre-load anti-back-lash assembly between the worm wheel and the nut.

3. A wheel dresser assembly for mounting on a grinding machine of the type that includes an adjusting member for adjusting the relationship between a grinding wheel and a work support of the machine, said dresser assembly including a dressing toolhead, means for securing a dressing tool to said toolhead, fine-feed adjusting means including an operator movable in one direction for moving the head to move the tool to increase the total extent of dressing, compensating means for connection to said adjusting member, said compensating means being coupled to the operator for movement as determined by the positioning of the tool by the fine-feed adjusting means in its movement in said one direction, and means included in the fine-feed adjusting means for disabling the same upon attempted movement of the fine-feed adjusting means operator in an opposite direction, and a spring pre-load anti-backlash assembly backing the toolhead to permit backing movement of the toolhead against the spring when the load on the toolhead exceeds the spring pre-load.

* * * * *